US005836834A

United States Patent [19]

Masutani et al.

[11] Patent Number: 5,836,834

[45] Date of Patent: Nov. 17, 1998

[54] GOLF BALLS

[75] Inventors: Yutaka Masutani; Keisuke Ihara; Hirotaka Shimosaka; Michio Inoue; Atuki Kasasima, all of Saitama, Japan

[73] Assignee: Bridgestone Sports Co., Ltd., Tokyo, Japan

[21] Appl. No.: 847,582

[22] Filed: Apr. 24, 1997

[30] Foreign Application Priority Data

Apr. 24, 1996 [JP] Japan ..... 8-127857

[51] Int. Cl.[6] ..... A63B 37/12; A63B 37/06

[52] U.S. Cl. ..... 473/374; 473/377

[58] Field of Search ..... 473/373, 374, 473/377

[56] References Cited

U.S. PATENT DOCUMENTS

| | | | |
|---|---|---|---|
| 700,658 | 5/1902 | Kempshall | 473/373 X |
| 704,748 | 7/1902 | Kempshall | 473/373 |
| 712,413 | 10/1902 | Richards | 473/374 |
| 720,852 | 2/1903 | Smith | 473/374 |
| 5,439,227 | 8/1995 | Egashira et al. | 473/374 X |
| 5,490,674 | 2/1996 | Hamada et al. | 473/373 |
| 5,692,973 | 12/1997 | Dalton | 473/374 |

*Primary Examiner*—George J. Marlo
*Attorney, Agent, or Firm*—Sughrue, Mion, Zinn, Macpeak & Seas, PLLC

[57] ABSTRACT

A two or three piece golf ball in which a boundary surface between concentric solid layers has a projection formed on the surface of a concentric solid layer having a high hardness such that the projection extends along an approximate normal direction, a depression corresponding to the projection is formed in the surface of a concentric solid layer having a low hardness, and the concentric solid layer having a high hardness and the concentric solid layer having a low hardness are joined together such that the projection is inserted into the depression. A golf ball comprising a two-layer solid core is composed of a low-hardness inner core and a high-hardness outer core joined around the low-hardness inner core. A projection is formed on the inner surface of the high-hardness outer core such that the projection extends along an approximate normal direction, while a depression corresponding to the projection is formed in the outer surface of the low-hardness inner core, and the low-hardness inner core and the high-hardness outer core are joined together such that the projection is inserted into the depression.

5 Claims, 5 Drawing Sheets

GOLF BALLS

BACKGROUND OF THE INVENTION

1. Field of the Invention

The present invention relates to a golf ball comprising at least a pair of adjacent concentric solid layers having different hardnesses.

2. Related Art

There exist golf balls comprising at least a pair of adjacent concentric solid layers having different hardnesses. Examples of such golf balls include three-piece golf balls having a two-layered solid core comprising an low-hardness inner core and an high-hardness outer core and two-piece golf balls comprising a high-hardness solid core enclosed with a low-hardness cover. In these golf balls, the low-hardness inner core and the high-hardness outer core or the high-hardness solid core and the low-hardness cover compose a pair of adjacent concentric solid layers.

In the above-mentioned golf balls, the border between the adjacent concentric solid layers forms a smooth spherical shape. Accordingly, an external force applied on impact to a golf ball is transmitted from an outer concentric solid layer to an inner concentric solid layer at a substantially constant ratio regardless of the direction along which the external force is applied. That is, the ratio between an external force transmitted from the outer concentric solid layer to the inner concentric solid layer and an external force applied to the outer concentric solid layer remains substantially constant. This is because in normal golf balls, the distance along which an external force is transmitted in the outer concentric solid layer varies little according to the direction along which the external force is applied. As a result, a conventional golf ball having a spherical boundary surface between concentric solid layers gives a substantially constant feel on impact irrespective of the direction along which an external force is applied to the golf ball.

For golf shots to give a golf ball a large backspin (a chip shot, for example), such as for an approach shot, a player performs a down blow swing using a golf club having a large loft. Consequently, upon impact, the club face of the golf club rubs the surface of the golf ball downward, resulting in the application of an external force to the golf ball substantially along a tangential direction (a tangent on the ball surface at a position hit by the club face). By contrast, for golf shots to give a golf ball a long travel distance, such as for a driver shot, a player performs an upper blow swing or level swing using a golf club having a small loft. Consequently, upon impact, the club face of the golf club hits the golf ball such that it substantially faces the center of the golf ball, resulting in the application of an external force to the golf ball substantially along a normal (a normal on the ball surface at a position hit by the club face).

Some golf balls comprising at least a pair of adjacent concentric solid layers having different hardnesses as described above are designed to provide a soft feel on impact when a player performs a shot, such as an approach shot, to give that golf ball a large backspin. Examples of such golf balls include the aforementioned three-piece golf balls and two-piece golf balls.

However, the above-mentioned golf balls designed to provide a soft feel on impact for an approach shot or the like cause a player dissatisfaction as described below when the player attempts a shot for a long travel distance, such as a driver shot. Since this type of a conventional golf ball has a spherical boundary surface between adjacent concentric solid layers as previously described, an external force applied to an outer concentric solid layer is transmitted to an inner concentric solid layer at substantially the same ratio between a driver shot or the like, at which an external force is applied to the golf ball substantially along a normal direction, and an approach shot or the like, at which an external force is applied to the golf ball substantially along a tangential direction. As a result, upon a driver shot, a deformation of the inner concentric solid layer, thus a deformation of the entire golf ball, becomes too large, resulting in too soft a feel on impact and thus giving a player an impression as if the golf ball had no core.

SUMMARY OF THE INVENTION

In view of the foregoing, it is an object of the present invention to provide a golf ball comprising at least a pair of adjacent concentric solid layers having different hardnesses and capable of giving a player different feels on impact depending on the direction of an external force applied thereto when hit.

To achieve the above object, the present invention provides a golf ball comprising at least a pair of adjacent concentric solid layers having different hardnesses, wherein, in at least one boundary surface between the concentric solid layers, a projection is formed on the surface of a concentric solid layer having a high hardness such that the projection extends along a normal direction of the solid layer, a depression corresponding to the projection is formed in the surface of a concentric solid layer having a low hardness, and the concentric solid layer having a high hardness and the concentric solid layer having a low hardness are joined together such that the projection is inserted into the depression.

In the present invention, a concentric solid layer refers to a solid layer which is formed of plastic, rubber, or the like as part of a golf ball. Examples of such a concentric solid layer include, but are not limited to, layers which compose a solid core having a multilayer structure, layers which compose a cover having a multilayer structure, and layers which compose a solid center having a multilayer structure and used in a thread-wound golf ball. Examples of a pair of adjacent concentric solid layers include, but are not limited to, adjacent layers of a solid core having a multilayer structure, a solid core and a cover of a two-piece golf ball, a cover and a core layer inside the cover of a multi-piece golf ball comprising a solid core having a multilayer structure, an innermost layer cover and a core layer inside the layer cover of a golf ball using a multilayer cover, and adjacent layers of a cover having a multilayer structure. In a golf ball of the present invention comprising a pair of concentric solid layers having different hardnesses, a concentric solid layer having a high hardness may be located outside and a concentric solid layer having a low hardness may be located inside, or a concentric solid layer having a low hardness may be located outside and a concentric solid layer having a high hardness may be located inside.

In this specification, the term "normal" means a straight line that passes through a certain point P on the surface of a golf ball and is perpendicular to a tangential plane at the point P. Therefore, it corresponds to a line (a radial line) which connects the point P and the center of the golf ball. Accordingly, a projection extending substantially along a normal direction in the present invention denotes a projection whose center line extends substantially along a radial line of a golf ball, and a depression corresponding to the projection denotes a depression whose center line extends substantially along the radial line of a golf ball.

A golf ball of the present invention comprises a pair or more of adjacent concentric solid layers and is structured such that, in at least one boundary surface between the concentric solid layers, a projection is formed on the surface of a concentric solid layer having a high hardness and a depression corresponding to the projection is formed in the surface of a concentric solid layer having a low hardness. When there are two or more such boundary surfaces, in one or more boundary surfaces, a projection may be formed on the surface of a concentric solid layer having a high hardness, and a depression corresponding to the projection may be formed in the surface of a concentric solid layer having a low hardness. The plane area of projections preferably accounts for approximately 5 to 40% of the plane area of the boundary surface so as to not impair the effect of the concentric solid layer having a low hardness. The shape of the projection is not particularly limited, and the projection may have a substantially cylindrical shape, a substantially pyramidal shape, a grid shape, a honeycomb shape, or a like shape. Preferably, the above-mentioned projections and depressions are uniformly arranged over the entire boundary surface between concentric solid layers.

A golf ball according to the present invention can give a player different feels on impact according to the direction of an external force applied thereto when hit. For example, when a player performs an approach shot on the golf ball, during which an external force is applied to the golf ball substantially along a tangential direction, the golf ball gives the player a soft feel on impact. By contrast, when the player performs a driver shot on the golf ball, during which an external force is applied to the golf ball substantially along a normal direction, the golf ball gives the player a hard feel on impact.

DESCRIPTION OF THE PREFERRED EMBODIMENTS

The present invention will be described in detail with reference to the drawings.

Figure 1:
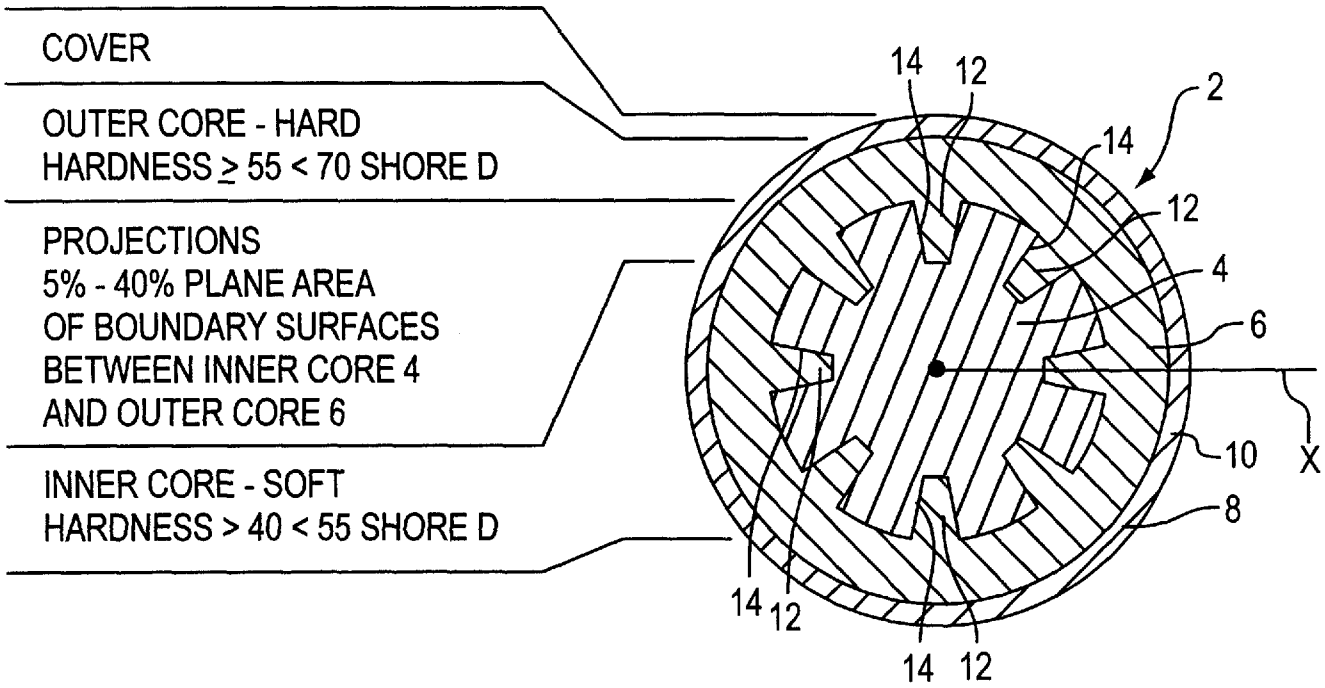
FIG. 1 is a sectional view showing an embodiment of a golf ball according to the present invention.

FIG. 1 shows a cross-section of a golf ball according to an embodiment of the present invention. A golf ball 2 shown in FIG. 1 is a three-piece golf ball comprising a solid core 8, having a two-layer structure with an low-hardness inner core 4 (a concentric solid layer having a low hardness) and an high-hardness outer core 6 (a concentric solid layer having a high hardness) are joined together, and a cover 10 which encloses the solid core 8. In this golf ball 2, a projection 12 is formed on the inner surface of the high-hardness outer core 6 along a normal X direction, while a depression 14 corresponding to the projection 12 is formed in the outer surface of the low-hardness inner core 4. In addition, the low-hardness inner core 4 and the high-hardness outer core 6 are joined together such that the corresponding projection 12 and depression 14 are engaged together. Preferably, in the golf ball 2 of FIG. 1, the low-hardness inner core 4 is formed of polybutadiene rubber or the like to have a hardness of not less than 40 but less than 55 on the Shore D scale, and the high-hardness outer core 6 is formed of polybutadiene rubber or the like to have a hardness of not less than 55 but not greater than 70 on the Shore D scale. The cover 10 may be formed of an ionomer resin or the like in a single layer or a multilayer.

Figure 2:
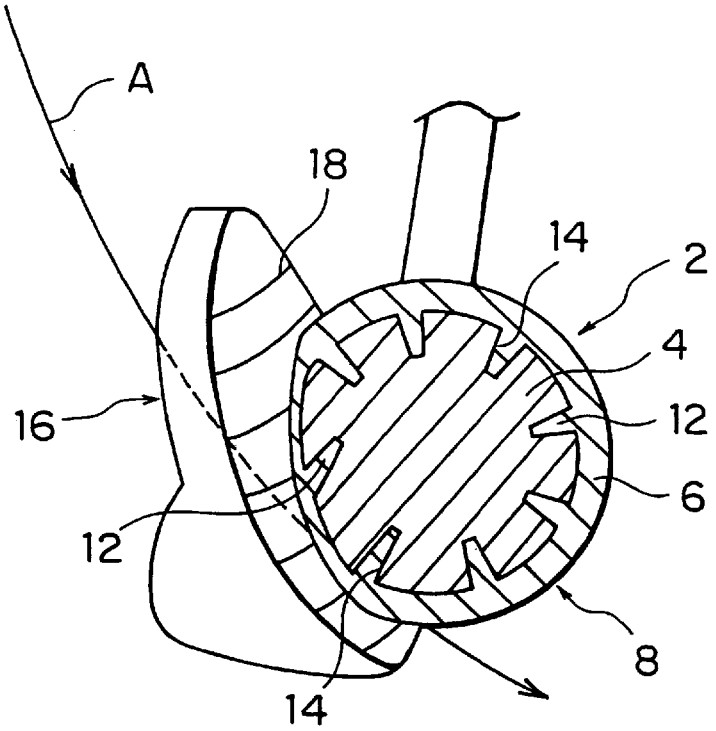
FIG. 2 is a sectional view schematically illustrating an action and effect of the golf ball shown in FIG. 1.
Figure 3:
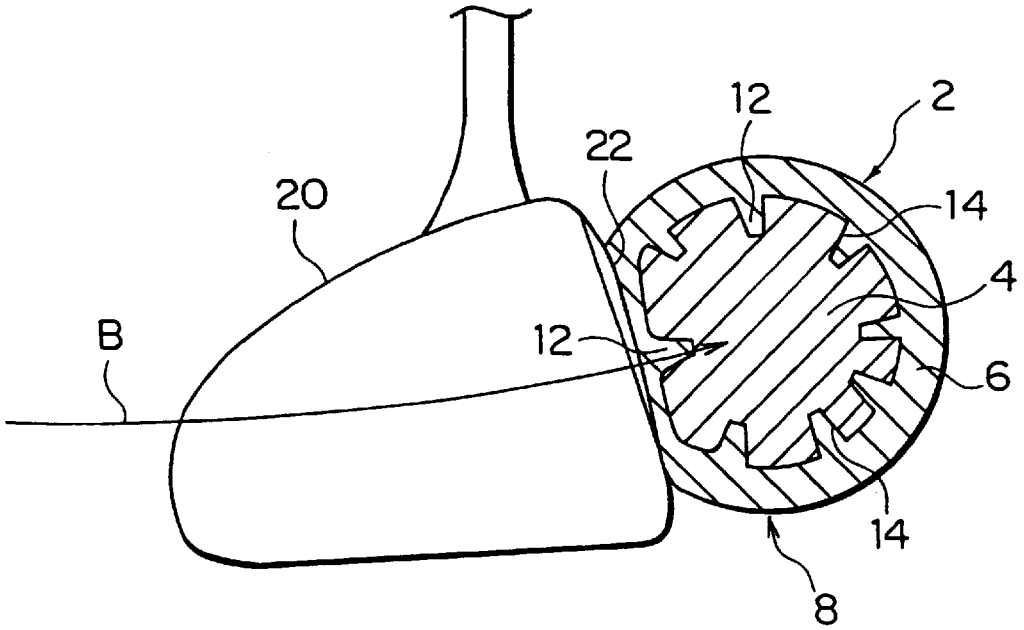
FIG. 3 is a sectional view schematically illustrating an action and effect of the golf ball shown in FIG. 1.

FIGS. 2 and 3 schematically illustrate an action and effect of the golf ball 2 shown in FIG. 1. In FIGS. 2 and 3, the cover 10 is omitted. As shown in FIG. 2, when the golf ball 2 is hit with an iron club 16 so as to be given a large amount of backspin, and thus a club face 18 moves on impact in such a manner as to slide down the surface of the golf ball 2, an external force is applied to the golf ball 2 substantially in a tangential direction (a direction of arrow A). In this case, in the golf ball 2, the projection 12 formed on the high-hardness outer core 6 is deformed such that it is bent at its root portion. Therefore, the external force applied on impact to the high-hardness outer core 6 is transmitted to the low-hardness inner core 4 such that the transmission is hindered only a little by the projection 12. Accordingly, the low-hardness inner core 4 deforms to a great extent similar to that of the case where the boundary surface between the low-hardness inner core 4 and the high-hardness outer core 6 is spherical, resulting in a soft feel on impact.

By contrast, as shown in FIG. 3, when the golf ball 2 is hit with a driver 20 or the like to obtain a long travel distance, and thus a club face 22 moves on impact substantially facing the central portion of the golf ball 2, an external force is applied to the golf ball 2 substantially in a normal direction (a direction of arrow B). In this case, in the golf ball 2, since the projection 12 formed on the high-hardness outer core 6 projects in the normal direction (i.e., radial), the projection 12 is not deformed such that it is bent at its root portion as shown in FIG. 2. Therefore, the external force applied on impact to the high-hardness outer core 6 is received by the projection 12, thereby hindering the external force from being transmitted from the high-hardness outer core 6 to the low-hardness inner core 4 by the projection 12. Accordingly, the deformation of the low-hardness inner core 4 is smaller than that of the case where the boundary surface between the low-hardness inner core 4 and the high-hardness outer core 6 is spherical, resulting in a hard feel on impact.

Figure 4:
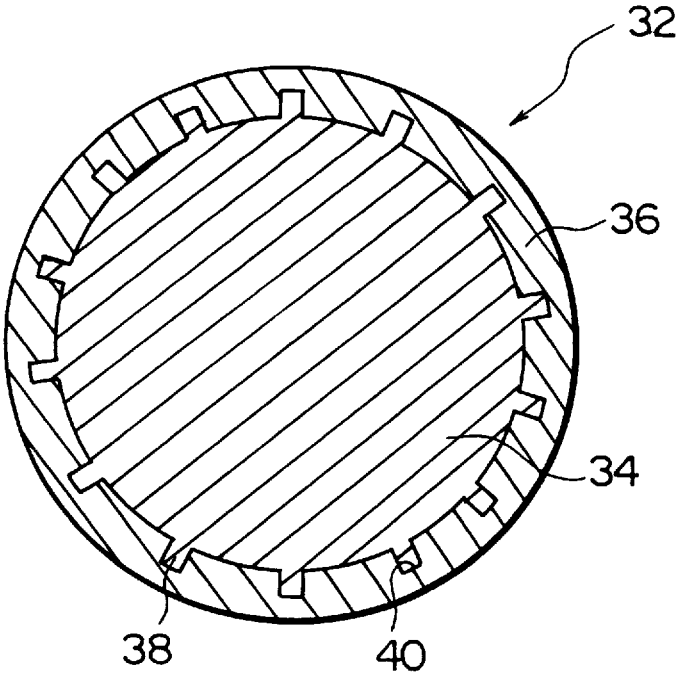
FIG. 4 is a sectional view showing another embodiment of the golf ball according to the present invention.

FIG. 4 shows a cross-section of a golf ball according to another embodiment of the present invention. A golf ball 32 shown in FIG. 4 is a two-piece golf ball comprising a high-hardness solid core 34 (a concentric solid layer having a high hardness) and a low-hardness cover 36 (a concentric solid layer having a low hardness), which encloses the high-hardness solid core 34. In this golf ball 32, a projection 38 is formed on the outer surface of the high-hardness solid core 34 along a normal direction, while a depression 40 corresponding to the projection 38 is formed in the inner surface of the low-hardness cover 36. In addition, the high-hardness solid core 34 and the low-hardness cover 36 are joined together such that the corresponding projection 38 and depression 40 are engaged together. This golf ball 32 also provides an action and effect similar to that of the golf ball 2 shown in FIG. 1. That is, when the golf ball 32 is hit with an iron club to be given a large backspin, the projection 38 is deformed such that it is bent at its root portion.

Therefore, the deformation of the low-hardness cover 36 becomes relatively large, resulting in a soft feel on impact. By contrast, when the golf ball 32 is hit with a driver or the like to obtain a long travel distance, an external force applied on impact to the low-hardness cover 36 is received by the projection 38. Therefore, the deformation of the low-hardness cover 36 becomes relatively small, resulting in a hard feel on impact.

Figure 5A:
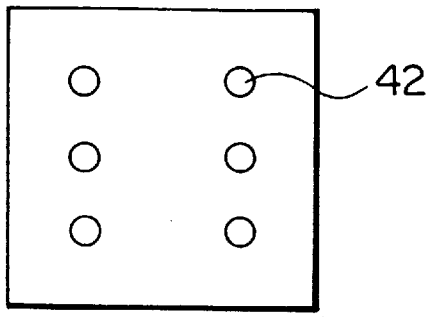
FIGS. 5A–5C are partial plan views showing projections formed on the surface of a concentric solid layer having a high hardness.
Figure 5B:
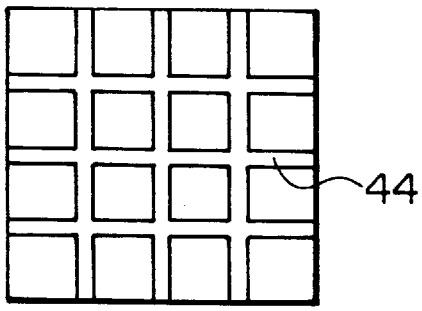
Figure 5C:
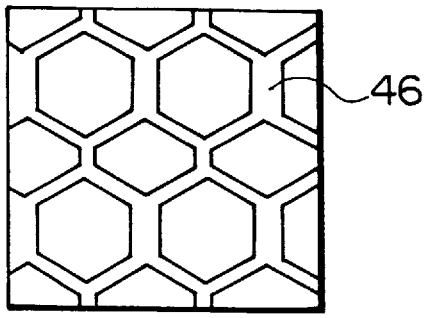

FIGS. 5A to 5C show the shape of projections formed on the surface of a concentric solid layer having a high hardness. The projections may have any shape as exemplified by a substantially cylindrical projection 42 in FIG. 5A, a grid-shaped projection 44 in FIG. 5B, or a honeycomb-shaped projection 46 in FIG. 5C. Depressions formed in the surface of a concentric solid layer having a low hardness may have a shape such that the projections are closely fit thereinto.

EXAMPLE

Figure 6:
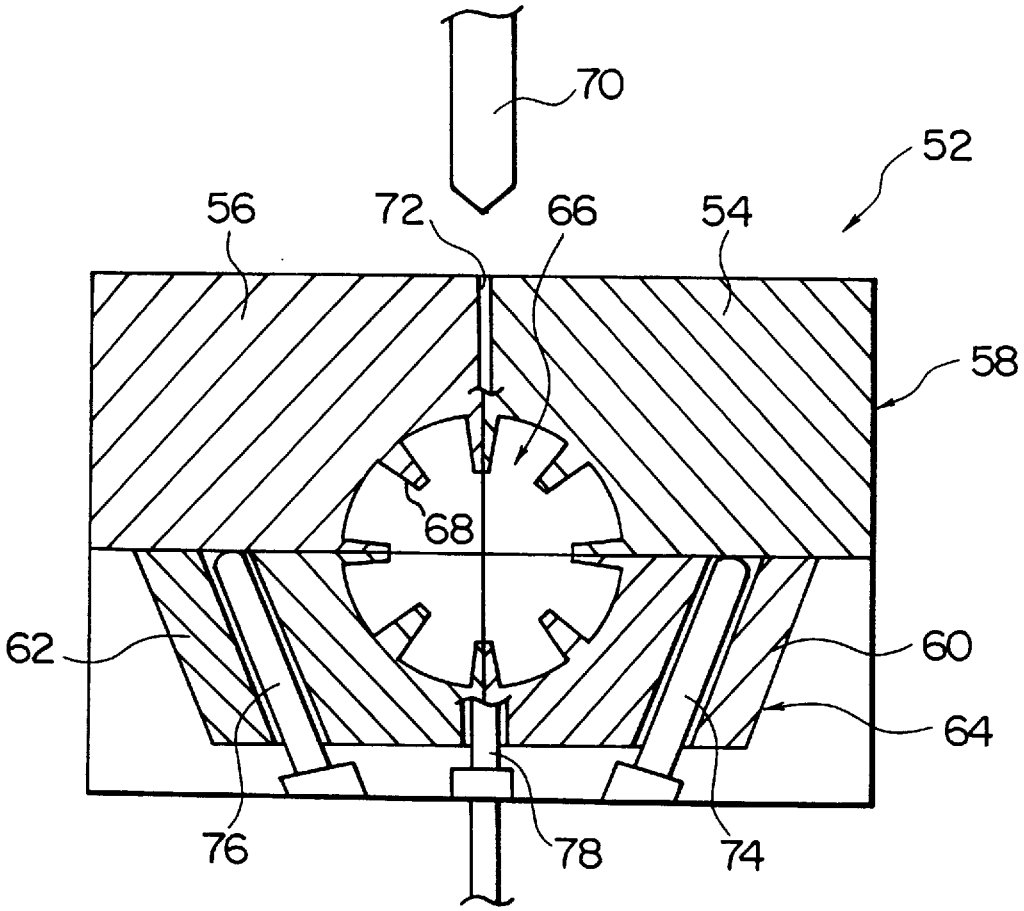
FIG. 6 is a sectional view showing a mold for forming a concentric solid layer of the golf ball of the present invention.

A golf ball 2 shown in FIG. 1 was manufactured. First, an low-hardness inner core 4 was injection-molded using a mold 52 shown in FIG. 6. The mold 52 comprises an upper split mold 58, composed of two upper blocks 54 and 56, and a lower split mold 64, composed of two lower taper blocks 60 and 62. In FIG. 6, numeral 66 denotes a cavity, numeral 68 denotes a projection for forming a depression 14, numeral 70 denotes an injection cylinder, numeral 72 denotes a gate, numerals 74 and 76 denote angular pins, and numeral 78 denotes an ejector pin. Next, the thus-obtained low-hardness inner core 4 was subjected to injection molding through the use of another mold so as to form an high-hardness outer core 6 therearound. Subsequently, the resulting solid core 8 was subjected to compression molding to enclose it with a cover 10 and form dimples on the cover 10.

The thus-obtained golf ball 2 was subjected to a chip shot given through the use of a pitching wedge and a full shot given through the use of a driver. As a result, the golf ball 2 provided a soft feel on impact at the time of a chip shot given through the use of the pitching wedge, and a hard feel on impact, an impression as if the golf ball had core, at the time of a full shot given through the use of the driver.

What is claimed is:

1. A three-piece golf ball comprising a two-layer solid core and a cover of ionomer resin which encloses the two-layer solid core, said two-layer solid core consisting of an inner core of low-hardness rubber and an outer core of high-hardness rubber disposed around the inner core with a boundary surface therebetween, wherein a plurality of projections are formed on the inner surface of the outer core such that the projections extend along an approximate radial direction, a plurality of depressions corresponding to the projections are formed in the outer surface of the inner core, the inner core and the outer core joined together such that the projections are closely inserted into the depressions, and the projections and the depressions are uniformly arranged over the entire boundary surface between the inner core and the outer core.

2. A golf ball according to claim 1, wherein the plane area of the projections accounts for 5 to 40% of the plane area of the boundary surface.

3. A golf ball according to claim 1, wherein the projections have a substantially cylindrical shape, a substantially pyramidal shape, a grid shape, or a honeycomb shape.

4. A golf ball according to claim 1, wherein the low-hardness inner core has a hardness of not less than 40 but less than 55 on the Shore D scale, and the high-hardness outer core has a hardness of not less than 55 but not greater than 70 on the Shore D scale.

5. A golf ball according to claim 1, wherein the low-hardness inner core and the high-hardness outer core are formed of polybutadiene rubber.

* * * * *